US005494133A

United States Patent [19]

Green et al.

[11] Patent Number: 5,494,133

[45] Date of Patent: Feb. 27, 1996

[54] CONTROLLED WEIGHT-LOWERING DEVICE

[75] Inventors: Kenneth Green, 2278 Old Hwy. 158, Belleville, Ill. 62221; Ewald Kerkhoff, Ann Arbor, Mich.; David Call, Meadeville, Pa.

[73] Assignee: Kenneth Green, Belleville, Ill.

[21] Appl. No.: 229,757

[22] Filed: Apr. 19, 1994

[51] Int. Cl.[6] ..... A62B 1/12

[52] U.S. Cl. ..... 182/238; 182/233

[58] Field of Search ..... 182/233, 238; 254/377

[56] References Cited

U.S. PATENT DOCUMENTS

| | | | |
|---|---|---|---|
| 3,519,248 | 7/1970 | Kushiro | 254/377 |
| 4,463,830 | 8/1984 | Geurtsen | 182/238 |
| 4,934,484 | 6/1990 | Green et al. | 182/5 |

FOREIGN PATENT DOCUMENTS

| | | | |
|---|---|---|---|
| 2286662 | 4/1976 | France | 182/238 |
| 2306110 | 8/1974 | Germany | 182/238 |
| 931194 | 6/1982 | U.S.S.R. | 182/238 |
| 750587 | 6/1956 | United Kingdom | 182/238 |

*Primary Examiner*—Alvin C. Chin-Shue
*Attorney, Agent, or Firm*—Don W. Weber

[57] ABSTRACT

A controlled weight-lowering device is presented which allows an individual to descend from a building at a predetermined rate of descent. The device can be permanently attached to the building or it can be portable. The device has an outer bracket which is securely attached to the inside of the building. Rotating about a shaft attached to the bracket is a cylindrical winding drum. The drum has a rope wound around it that is attached to a harness. The individual puts on the harness he desires to descend. Inside the winding drum is an inner gear pump and valve mechanism which is surrounded by an oil reservoir. Oil is allowed to go into the gear set chamber and circulates past the gears. The rate of flow of the oil out of the gear set chamber is regulated by a spring biased tapered piston. As the strength of the spring biasing is set on the piston, the rate of flow of oil within the gear set chamber is regulated. Because the gear set is connected to the cylindrical axis of the winding drum, controlling the rate of flow of oil, which controls the rate of rotation of the gears, also controls the rate of rotation of the drum.

7 Claims, 7 Drawing Sheets

CONTROLLED WEIGHT-LOWERING DEVICE

BACKGROUND OF THE INVENTION

This invention relates to the field involving fire escape devices. More particularly, it presents a device which allows the controlled descent of a human being or other object from a building.

Lowering objects has been a part of man's work for thousands of years. Over the many years, man has developed a number of devices to help him lower weights from heights, whether they be from the tops of trees, cliffs, or modern day buildings. Some such devices used by man in lowering weights include pulleys, a block-and-tackle system, fulcrums, electric motors and similar devices. Some of these devices allow for the controlled lowering of weights while others do not.

In escaping from a burning building it is often necessary for a human being to exit from the window if the stairways or other means of exit are otherwise blocked by the fire. Many fire departments carry long ladders which may be used to rescue people from burning buildings. Large nets or trampoline-like surfaces are also used if the person trapped in the building can be coaxed to jump from great heights. Oftentimes, however, a person may not be able to jump from the window and may need an alternate means of exit from the dangerous condition. An object of this invention is to provide a safe means of exit of an individual from a burning building that allows the individual to lower himself at a pre-set pace.

Another object of this invention is to allow a number of individuals to lower themselves from a burning building by use of the instant device. A still further object of this invention is to allow an individual to lower himself from a burning building by use of a rope and gear mechanism that controls the descent of the individual.

A still further object of this invention is to provide a device that will discontinue lowering the individual once he reaches the ground and the load on the rope and pulley device is terminated. Still further and objects of this invention will become obvious upon reading the following Specification.

BRIEF DESCRIPTION OF THE PREFERRED EMBODIMENT

This device comprises an outer bracket which is securely attached near the window of a building. The device remains in a case until needed. One end of the device is attached firmly to the inside of the building while a rope and harness attachment is provided at the other end for securing the device to the individual wishing to descend. A special gear pump and valve mechanism allows the individual who is to descend to traverse the distance between the high window and the ground at a controlled pace (approximately four feet per second) until the individual is safely on the ground. This controlled descent is accomplished by means of keying the winding drum of the device to an inner gear mechanism. This inner gear mechanism has oil flowing through the gear chamber from an oil reservoir. The rate of flow of the oil through the gear chamber is regulated by a regulating piston which in turn is operated by a disc-spring. As the regulating piston regulates the rate of flow of oil in and out of the gear chamber, the rate of descent of the weight at the end of the rope is in turn regulated.

BRIEF DESCRIPTIONS OF THE DRAWINGS

DETAILED DESCRIPTION OF THE PREFERRED EMBODIMENT

Figure 1:
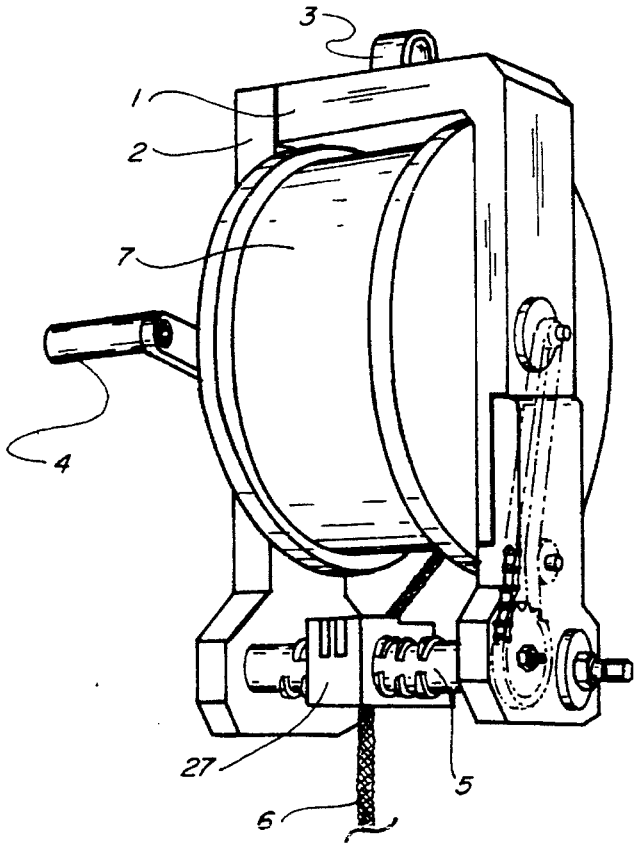
FIG. 1 is a perspective view of the preferred embodiment showing the outward appearance of the device.
Figure 2:
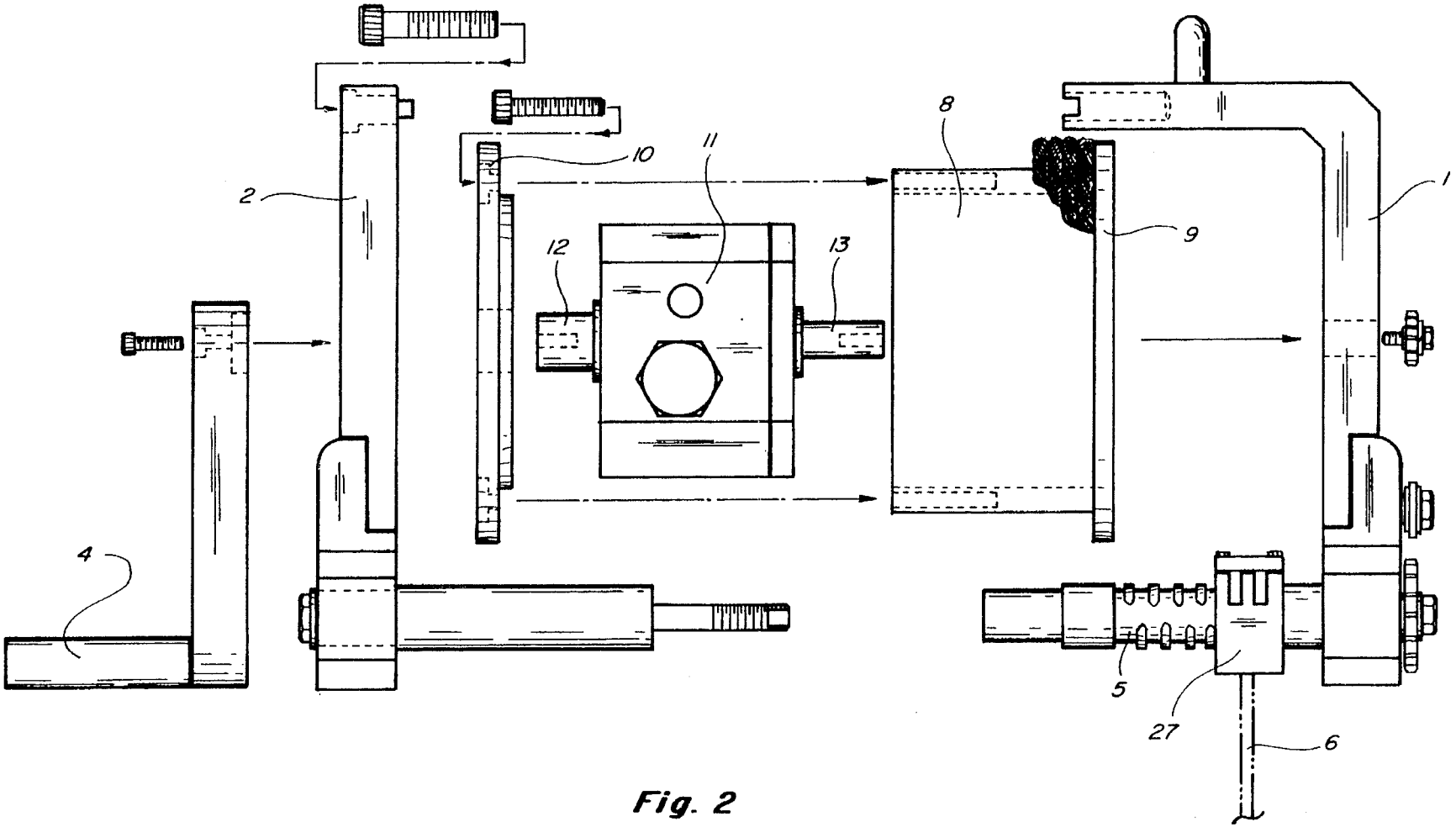
FIG. 2 is an exploded view of the device showing the various functional parts.

The controlled weight-lowering device is shown as it would appear to the consumer in FIG. 1. The device comprises an essentially inverted L-shaped outer bracket 1 to which is attached an essentially vertical left outer bracket 2. This outer inverted U-shaped bracket is attached to the inside of a building by means of the upper attaching bracket 3. The device has a detachable handle 4 which is attached to the central shaft 12 of drum 8, as shown in FIG. 2. The preferred embodiment of the device also has a lower horizontal rope guide bar 5 although this rope guide bar may be modified or may be omitted from other embodiments of the device while keeping within the spirit of this invention.

The object of this invention is to lower a weight, in the case of fire a human being, by means of a rope 6. While this rope may be nylon or of other material, the preferred embodiment utilizes a steel cable for greater tensile strength. The rope or cable 6 is wound about the circumference of a cylindrical rope winding mechanism 7, as shown on FIG. 1. Rope winding mechanism 7, shown generally on FIG. 1, comprises a rope winding drum 8 (FIG. 2) as well as right 9 and left 10 drum plates. The winding drum 8 rotates about its central axis on shafts 12 and 13.

Turning now to the exploded view of the device shown on FIG. 2, the outer L-shaped bracket 1 and left vertical outer bracket 2 are shown in their disassembled states along with the detachable handle 4 and the rope guide bar 5. Inside the rope winding drum 8 is the inner controlling mechanism housing 11. This inner controlling mechanism housing is also shown on FIG. 3.

The controlling housing is irregularly shaped and is keyed to the rope winding drum 8 by means of a controlling mechanism keyed shaft 13 and controlling mechanism key 14. This controlling mechanism keyed shaft 13 is located on the right side of the inner controlling mechanism housing 11 as shown on FIG. 2. Attached to the left side of the inner controlling mechanism house 11 is a controlling mechanism handle shaft 12. The raising handle 4 is detachably connected to the controlling mechanism handle shaft 12 by the bolt or other means as shown on FIG. 2.

Figure 3:
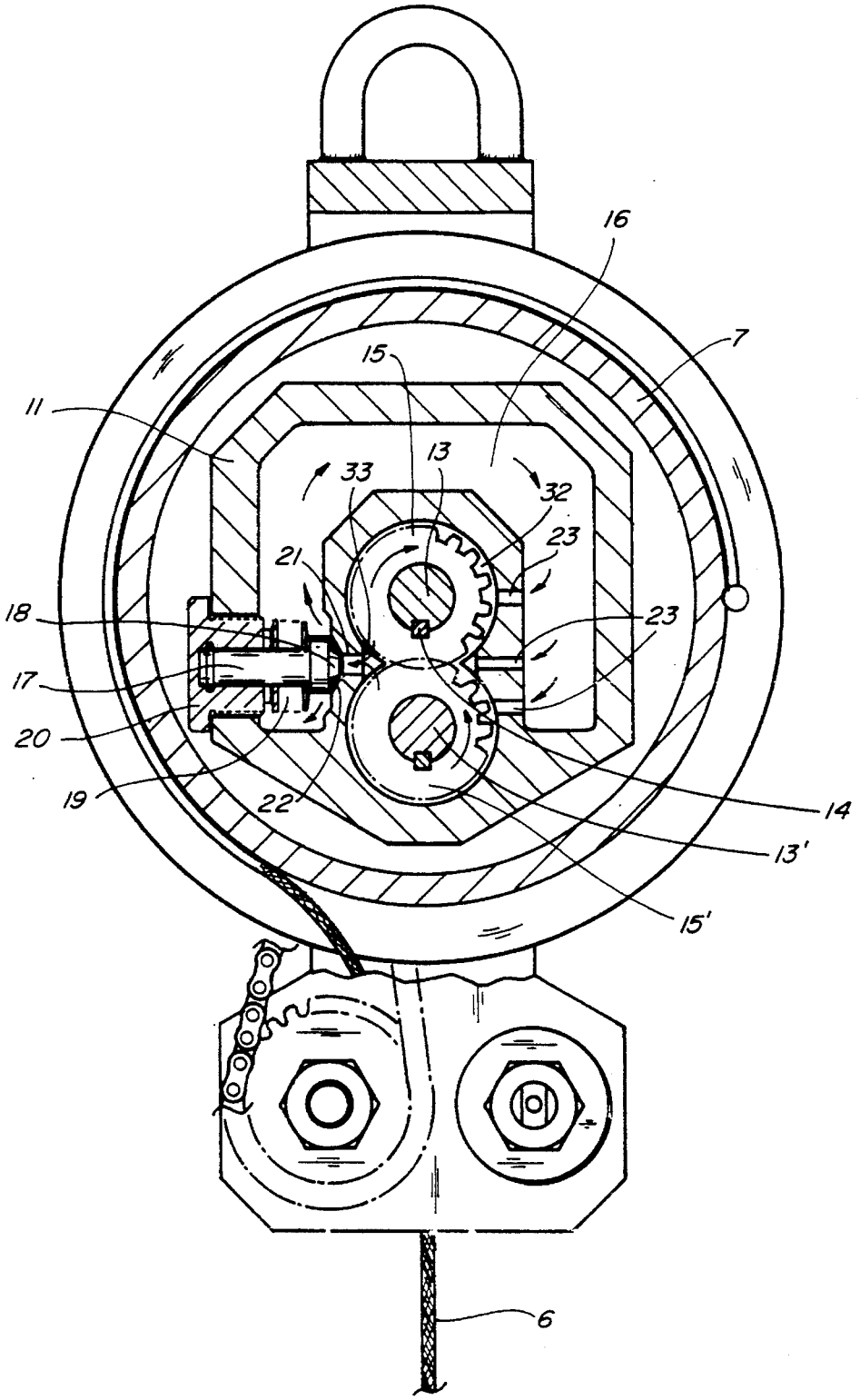
FIG. 3 is a side cutaway view of the device taken from the right to left direction of FIG. 1.

Turning now to the left side cutaway view of the device shown on FIG. 3, the internal gear pump and valve mechanism is shown. Inside the inner controlling mechanism housing 11 is a gear chamber 32 containing a plurality of controlling gears 15 and 15'. The intermeshing teeth of gears 15 and 15' have extremely close tolerances and prevent the oil from flowing through the teeth. These gears thus prevent the flow of oil through the gear teeth thereby building and maintaining pressure near the inner outlet. The upper controlling gear 15 is connected to the controlling mechanism keyed shaft 13 and is keyed to that shaft by means of upper controlling gear key 14. Keyed shaft 13 is in turn connected to the outer rope winding mechanism 7 as previously indicated.

Partially surrounding the controlling gears 15 and 15' but inside the controlling mechanism housing 11 is an inverted U-shaped oil chamber 16. This oil chamber contains regular grade hydraulic fluid which has a high flame point. The oil in the oil chamber 16 circulates in the clockwise direction shown by the arrows in the oil chamber.

In order to control the circulation of the hydraulic oil fluid a controlling piston 17 is located opposite the gear chamber outlet port 21 on the left side of the gear mechanism. This controlling piston 17 is essentially cylindrical in shape but has a controlling piston taper 18 on the right side of said piston as shown on FIG. 3. As pressure is created by the accumulation of oil near the inner outlet port opening 33, this controlling piston taper 18 conforms to the configuration of the oil chamber outlet taper 22 shown adjacent to the piston taper 18 on FIG. 3. The controlling piston 17 moves further away from the oil chamber outlet taper 22. This piston taper/gear taper distance is regulated by means of a biased disc-spring 19, often referred to as a Belleville washer in the United States or a Schnorr Spring in Europe. The tension on this disc-spring is adjustable so that the amount of oil flowing through the gear chamber 32 and controlling gears 15 and 15' may be regulated.

The controlling piston 17 is located in a piston housing 20 as shown in FIG. 3. Oil chamber outlet port 21 is a narrow cylindrical outlet which is regulated by the distance between the oil chamber outlet port taper 22 and the controlling piston taper 18. That distance, in turn, is regulated by means of adjusting the disc-spring 19 previously described.

Oil in the oil chamber 16 circulates in the clockwise direction of the arrows shown in FIG. 3. Oil circulates from the oil chamber 16 through outlet ports 23 into the gear chamber 32, past the controlling gears 15 and 15', and then exits the gear chamber outlet 21. Typically, the gear chamber outlet 21 is approximately 11/16ths inch in diameter. However, the outlet diameter may vary from 11/32nds to ¾ths of an inch depending on the weight load on the rope.

The device is designed to be securely attached to the building near a window by means of the upper attaching bracket 3. Alternatively, if the unit is used as a portable device, a tether line would be attached to bracket 3 and secured to a permanent anchor in the room.

At the free end of the rope 6 is a harness similar to a parachute harness. In using the device, one simply attaches the parachute harness to one's body, which is in turn attached to the free end of the rope 6. One lowers oneself out of the window and descends at a pace that approximates four feet per second. This approximately four feet per second descent is regulated by means of the pre-set controlling piston 17 as previously described.

Once the person descending reaches the ground, the demand on the rope 6 and gears 15 and 15' is no longer present and the rope discontinues its downward motion. The handle 4 is detached to the device upon descending but may be reattached once the individual is safely on the ground. Reattaching the handle will allow another individual to rewind the rope to the upper part of the building where the device may be used by subsequent individuals.

As shown most descriptively in FIG. 3, the wire rope 6 which is coiled on the drum 8 will lower an individual of average weight at the pre-set rate of descent. In the preferred embodiment, the adjustment of the controlling piston 17 is pre-set so that the device will accommodate individuals ranging from small children to large grown adults. However, an alternate embodiment of this device allows for the individual user to adjust the rate of descent by an outer adjustment mechanism. It will be appreciated that the placement of this outer adjustment mechanism is well known in the art.

The piston 17 is biased towards outlet port 21 by means of the disc springs, and allows oil flow from the gear set 15 and 15' through the gear chamber outlet port 21. This gear chamber outlet is approximately 11/16th" in diameter but the oil flow is constricted by means of the piston taper 18 as it approaches the outlet port taper 22.

As can be appreciated from the aforementioned, when weight is placed in the safety belt harness, this weight will cause the drum 8 to turn which in turn spools lengths of rope downward. (The length of the rope may be any length necessary for the particular application.) The turning drum also turns the keyed shaft 13 which in turn rotates the controlling gears 15 and 15'. Lower gears 15' rotates about shaft 13', as shown on FIG. 3 As the gear set 15 and 15' rotates in the counterclockwise direction shown by the arrow on FIG. 3, the gears, turning against each other, create a vacuum and suck oil out of the oil chamber through the oil chamber inlets 23. The inlet oil, passing through the gear chamber 32 is eventually forced out of the gear chamber through outlet port 21. The pressure created by this oil flow pushes against the piston taper 18, opening the valve unit and allowing oil to flow back into oil chamber 16. This oil flow pressure acts against the pre-set spring pressure on the disc-spring.

The pre-set spring pressure allows the controlled rate of descent of the individual from the building. This pressure may be set for a controlled drop of four feet per second, or it may be set for a faster drop of approximately seven to eight feet per second. The controlled descent may be set at any desired rate. The speed can be adjusted by setting the piston 17 against the weight to be applied at a permanent speed no matter how heavy the weight will be. It has been shown that the controlling piston 17 and taper 18 will begin to open when a weight of approximately ten kilograms is attached to the bottom of the rope 6.

The preferred embodiment herein (outlet port diameter of 11/16ths inches) lowers a weight of approximately 150 pounds. For larger weights, a larger outlet port diameter can be provided (for example, a 400 pound weight would require a diameter of approximately ¾th of an inch).

In order to regain use of the device, one attaches the handle 4 to the handle shaft 12 and turns the handle in the opposite direction from the counterclockwise turning of the shaft in descent. Turning the handle in the clockwise direction will course the gear movement in an opposite direction. The gear set will still suck oil but it will pull the oil through the outlet opening 21 when the direction is reversed. Turning the handle so that the shaft 13 turns in the clockwise direction will spool the rope 6 back onto the drum 8 and return the mechanism to the wound position.

It has been found that the main housing material should be made from steel. Since there is a large amount of pressure inside the oil pressure chamber 16 and gear chamber 32, it is imperative that the tensile strength of the casements be made quite strong in order to allow the device to function. It is expected that 1/10,000 of an inch tolerance should be maintained between the various parts since such is essential to the proper functioning of the gear mechanism. The process used in machining the main housing will be to rough machine the housing, stress relieve the steel and then to finish machine the steel.

This device also comprises a rope guide shaft 5 and block 27 to insure proper winding of the rope across the winding drum 8 as the rope is lowered or raised. In order to accomplish this systematic winding of the rope on the drum 8, a rope guide mechanism is provided as shown on FIGS. 3 and 4.

Figure 4:
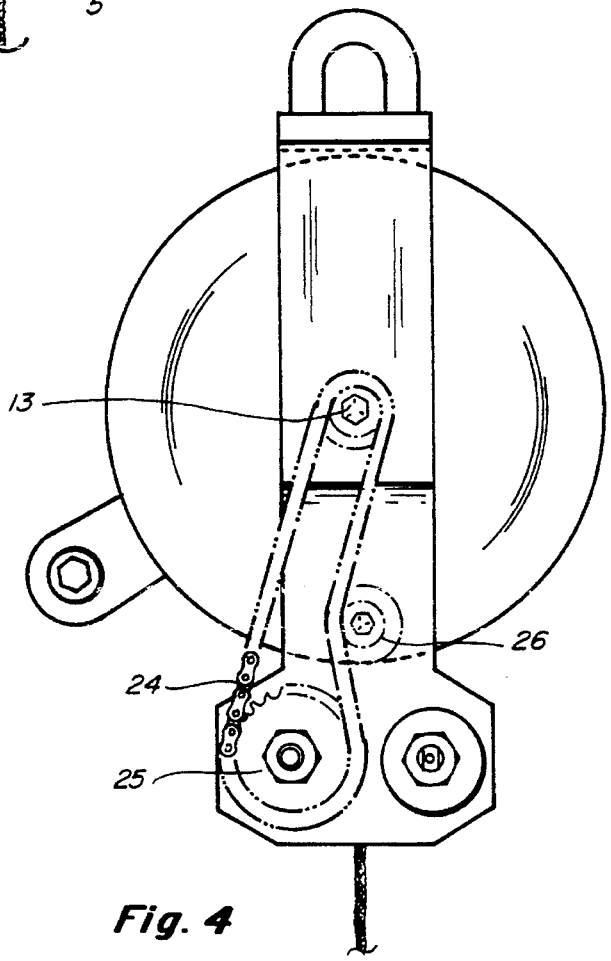
FIG. 4 is a right side view of the device shown in FIG. 1.

The rope guide mechanism includes a rope guide chain 24, shown on FIG. 4, which is driven by a gear attached to the controlling mechanism keyed shaft 13. This rope guide chain 24 is in turn attached to a rope guide shaft gear 25. (The rope guide chain is tensioned by a tensioning gear 26 as shown on FIG. 4.) The rope guide shaft gear 25 is attached to the rope guide shaft 5 as best shown on FIG. 1. This rope guide shaft 5 may be threaded so that a rope guide block 27 (FIG. 2) will move from the right to the left and back from the left to the right, alternately as the rope guide chain 24 turns. This rope guide block 27 moves back and forth across the rope guide shaft 25 thus systematically winding the rope onto the winding drum 8 when it is desired to rewind the rope. The mechanism is similar to the mechanism found on the common rod and reel and is within the ordinary skill of the rope winding art.

Figure 5:
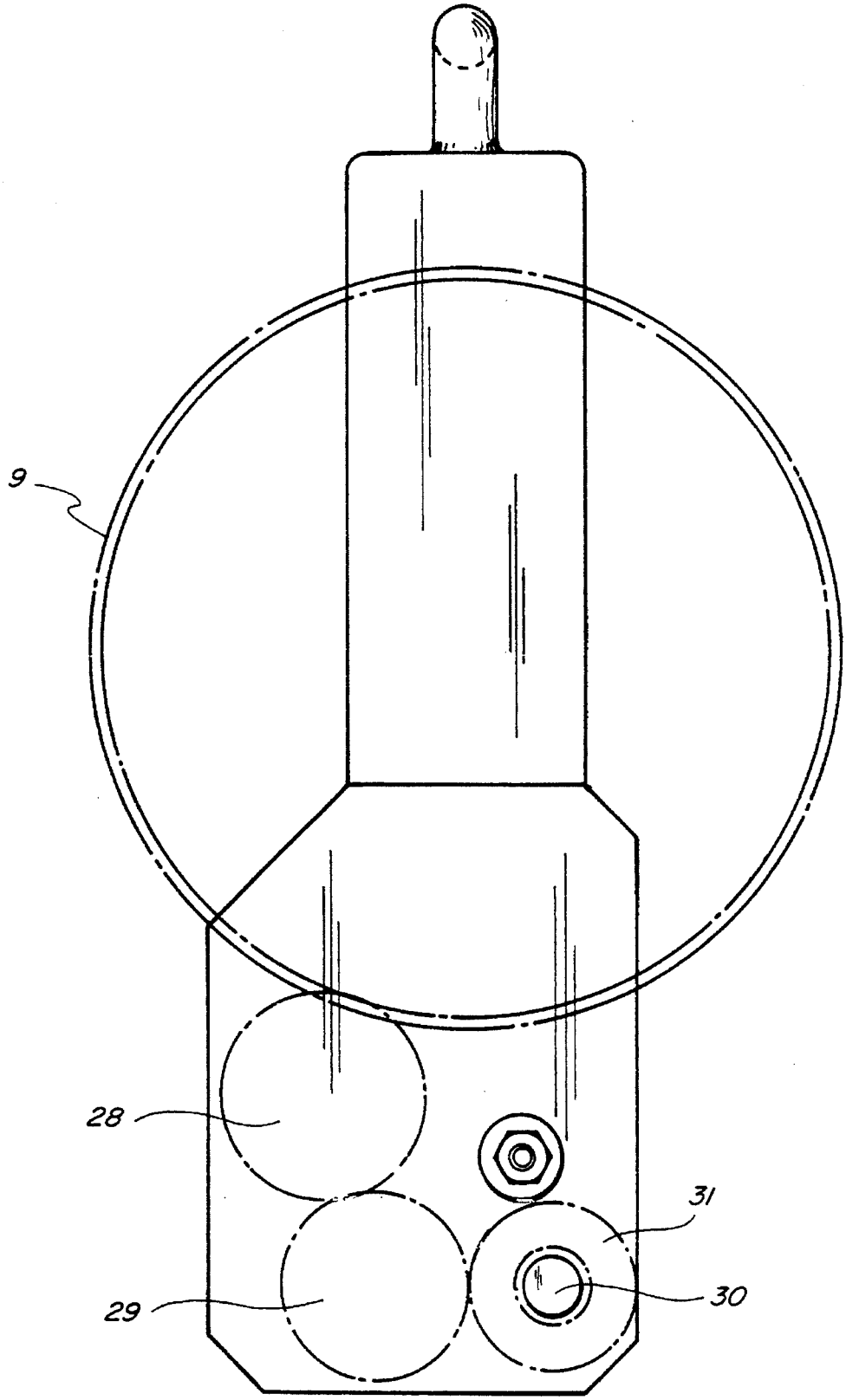
FIG. 5 is a left side view of the device showing an alternative means for guiding the rope as it winds on the drum.
Figure 6:
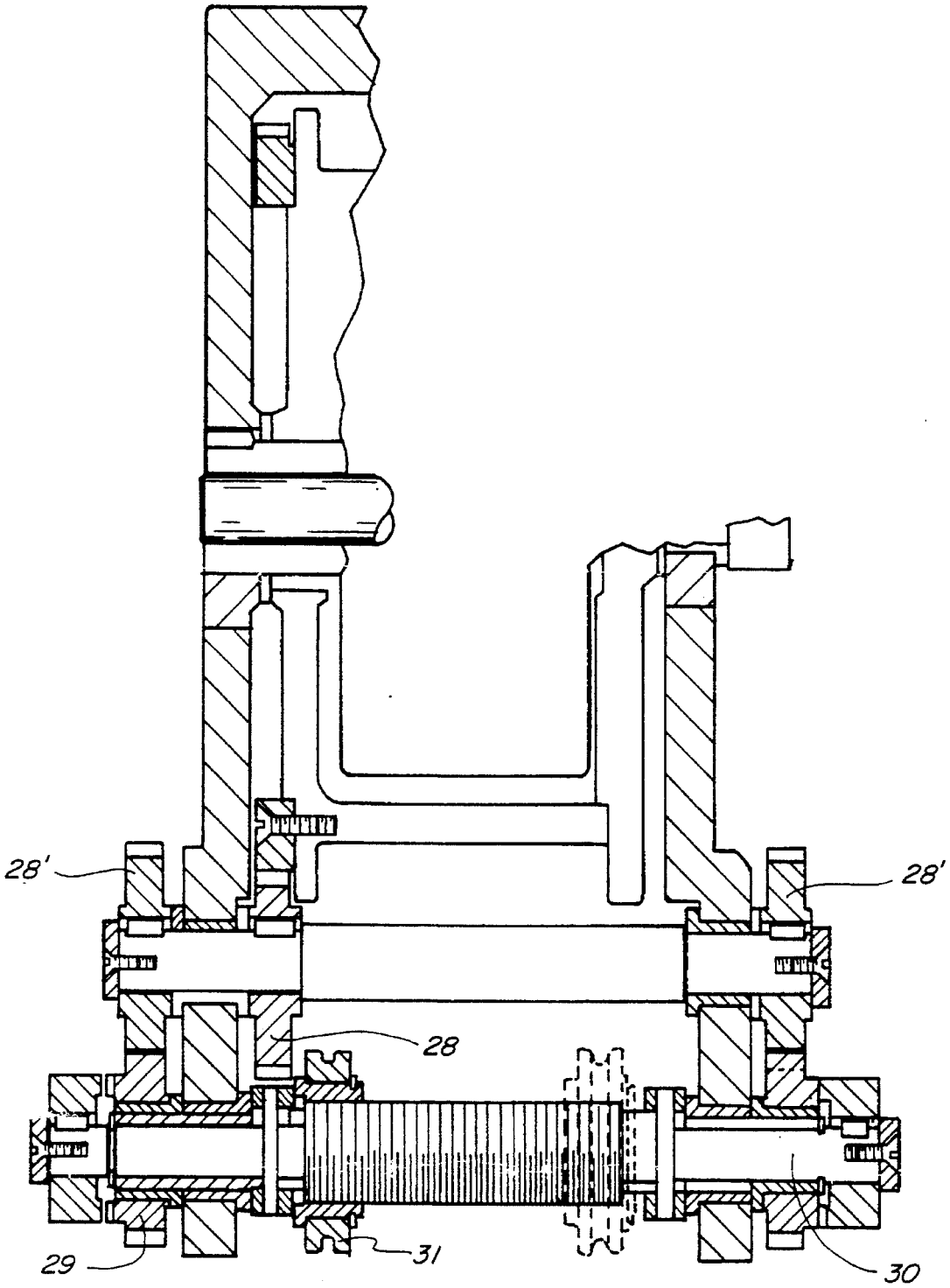
FIG. 6 is a front cutaway view of the alternate embodiment of the devices shown in FIG. 5.

An alternative embodiment of the device involves a different means of systematically winding the rope onto the rope winding drum 8. This embodiment is shown in FIGS. 5 and 6. As shown on FIG. 5, the outer circumference of the right plate 9 and left plate 10 of the rope winding drum 8 is geared so that it is in contact with and drives an alternate upper rope guide shaft gear 28. This upper shaft gear 28 is in contact with and drives a lower rope guide shaft gear 29, which in turn drives the alternate rope guide shaft 30. Attached to this alternate rope guide shaft 30 is an alternate rope guide shaft block 31 as shown on FIG. 6. As the drum 8 turns, it turns the right 9 and left 10 drum plates. As shown on FIG. 6, these drum plates in turn drive a set of gears 28, transfer gears 28', and lower gear 29 which turns the alternate shaft 30 and in turn the alternate rope guide block 31. When the alternate rope guide block 31 reaches the extreme end of its threaded motion, the gears on the opposite side of shaft 30 then come into contact with the driving motion of the opposite drum plate and reverse the direction of the rope guide block. This alternate embodiment provides a second means for systematically winding the rope 6 onto the rope winding drum 8.

Figure 7:
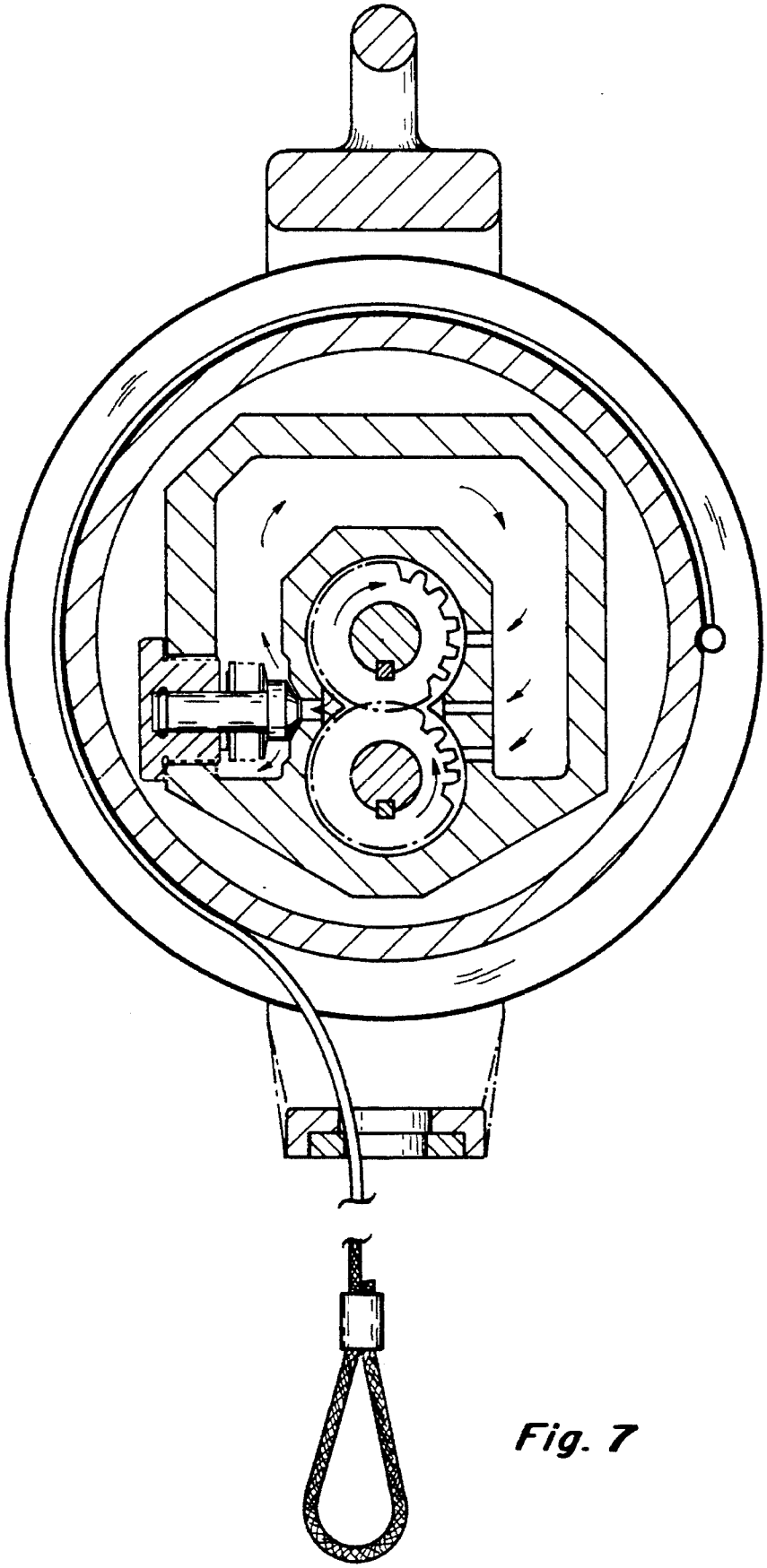
FIG. 7 is a cutaway view of a second alternate embodiment of the device without a rope guide mechanism.
Figure 8:
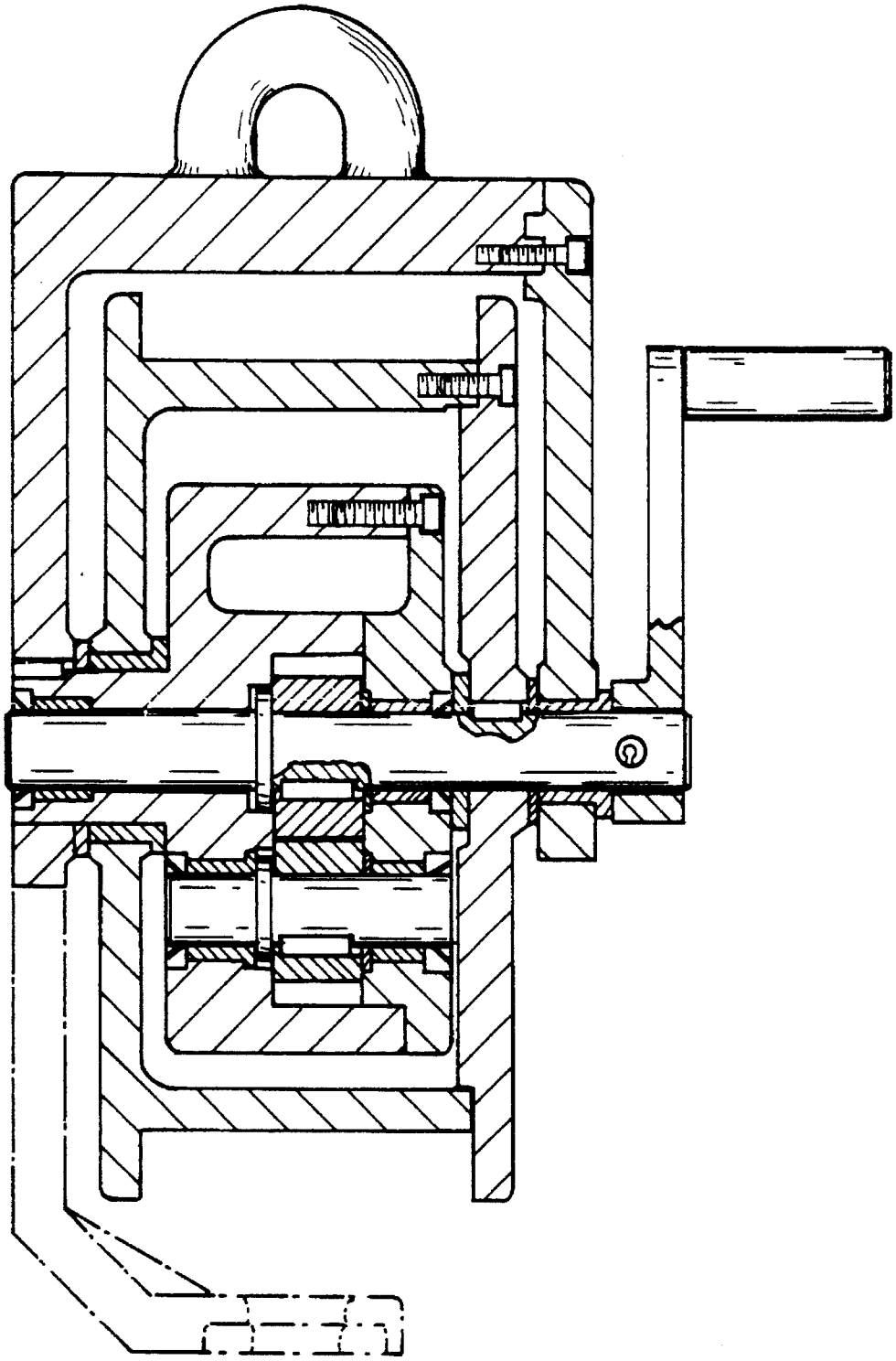
FIG. 8 is a front cutaway view of the device shown in FIG. 7 without any rope guide mechanism.

In a final embodiment, shown on FIGS. 7 and 8, the rope winding mechanism may be completely omitted from the device. While this may result in the rope 6 being wound onto the rope winding drum 8 in a haphazard fashion it has been found that such a device may be useful in some applications.

Having fully described my device, I claim:

1. A controlled weight lowering device for lowering human beings or other objects, comprising:

(a) an outer attaching bracket which supports a rotating drum, said drum rotating about a keyed shaft attached to said bracket;

(b) said drum having a rope wound about its circumference and containing an inner controlling mechanism;

(c) said controlling mechanism comprising:

(1) a gear chamber having a pair of rotating intermeshed gears wherein the teeth of said gears have very close tolerances whereby oil within said gear chamber cannot flow between said gear teeth and wherein one of said gears is connected to said rotating keyed shaft, said gear chamber having a plurality of inlet ports and one cylindrical outlet port;

(2) an oil reservoir surrounding said gear chamber wherein oil from said reservoir circulates into said gear chamber through said inlet ports;

(3) a tapered piston for controlling the rate of flow of oil out of said gear chamber through said outlet port, said piston being biased closed towards said cylindrical outlet port by a disc-spring, wherein said disc-spring may be pre-set to open said outlet port when a pre-determined rotational force is applied to said drum and wherein said disc-spring may be adjusted while said lowering device is in use to regulate the rate of descent of said human or object.

2. A controlled weight lowering device for lowering a human being or other object as in claim 1, wherein the tolerance between said gear teeth is approximately 1/10,000th of an inch.

3. A controlled weight lowering device for lowering a human being or other object as in claim 1, wherein said gear chamber outlet has a diameter between 11/32nd and ¾th of an inch.

4. A controlled weight lowering device for lowering a human being or other object as in claim 1, wherein the diameter of said gear chamber outlet is 11/16th of an inch.

5. A controlled weight lowering device as in claim 1, further comprising a means for systematically winding said rope unto said drum.

6. A controlled weight lowering device as in claim 1, wherein said systematic winding means comprises a guide-block which continually traverses back and forth across a guideshaft, said guideshaft being connected to said keyed shaft by means of a chain.

7. A controlled weight lowering device as in claim 1, further comprising a handle detachably connected to said drum and controlling mechanism, whereby said rope may be rewound upon said drum.

* * * * *